US008087416B2

(12) United States Patent
Defenbaugh et al.

(10) Patent No.: US 8,087,416 B2
(45) Date of Patent: Jan. 3, 2012

(54) HAIR CLIP WITH CONCEALED HINGE SPRING

(75) Inventors: Michael Defenbaugh, Marietta, GA (US); Justin Recchion, Atlanta, GA (US)

(73) Assignee: Goody Products, Inc., Atlanta, GA (US)

( * ) Notice: Subject to any disclaimer, the term of this patent is extended or adjusted under 35 U.S.C. 154(b) by 333 days.

(21) Appl. No.: 12/431,256

(22) Filed: Apr. 28, 2009

(65) Prior Publication Data

US 2009/0272397 A1 Nov. 5, 2009

Related U.S. Application Data

(60) Provisional application No. 61/049,111, filed on Apr. 30, 2008.

(51) Int. Cl.

| | |
|---|---|
| ***A45D 8/20*** | (2006.01) |
| ***A45D 24/00*** | (2006.01) |
| ***A41F 1/00*** | (2006.01) |
| ***A41F 1/08*** | (2006.01) |
| ***A44B 1/04*** | (2006.01) |
| ***A44B 11/25*** | (2006.01) |
| ***A44B 17/00*** | (2006.01) |
| ***B42F 1/00*** | (2006.01) |

(52) U.S. Cl. ..... 132/277; 132/200; 24/510

(58) Field of Classification Search ..... 132/277, 132/200, 212, 219, 106, 107, 128, 129, 134–140, 132/144–146, 148, 156, 273, 276, 278, 279, 132/275, 282; 24/509, 510, 511

See application file for complete search history.

(56) References Cited

U.S. PATENT DOCUMENTS

| | | | | |
|---|---|---|---|---|
| 4,141,119 | A * | 2/1979 | Nodo | 24/504 |
| 4,506,416 | A * | 3/1985 | Ohminato et al. | 24/67 R |
| 5,457,858 | A * | 10/1995 | Lin | 24/511 |
| 5,621,955 | A * | 4/1997 | Schmid et al. | 24/511 |
| 5,642,740 | A | 7/1997 | Chen | |
| 5,666,702 | A * | 9/1997 | Ming-Chieh | 24/510 |

(Continued)

FOREIGN PATENT DOCUMENTS

EP 1905321 A1 4/2008

OTHER PUBLICATIONS

International Search Report and Written Opinion of the International Searching Authority for PCT/US2009/041922; date of mailing Jun. 22, 2009; 9 pages.

*Primary Examiner* — Todd Manahan
*Assistant Examiner* — Vanitha Elgart
(74) *Attorney, Agent, or Firm* — Lempia Summerfield Katz LLC

(57) ABSTRACT

A hair clip having two body members pivotally coupled together by a concealed-spring hinge mechanism. The hinge mechanism includes a housing and a spring concealed within the housing in normal use of the hair clip. In typical commercial embodiments, the housing is integrally formed with a first one of the body members in a one-step process. The housing defines an inner-end access opening through which the spring is inserted during the manufacturing process. The access opening is closed off by a second one of the body members when the hair clip is assembled for use. The hair clip may be manufactured with the housing initially fabricated on the first body member in a one-piece construction.

19 Claims, 6 Drawing Sheets

U.S. PATENT DOCUMENTS

| | | | | |
|---|---|---|---|---|
| 5,735,296 | A * | 4/1998 | Chen | 132/277 |
| 5,842,482 | A | 12/1998 | Potut | |
| 5,862,815 | A * | 1/1999 | Murphy et al. | 132/277 |
| 6,186,151 | B1 * | 2/2001 | Newlin | 132/273 |
| 6,189,542 | B1 * | 2/2001 | Shepard | 132/273 |
| 6,354,307 | B1 | 3/2002 | Potut | |
| 6,357,452 | B2 * | 3/2002 | Bolito | 132/277 |
| 6,408,859 | B1 * | 6/2002 | Shyu | 132/276 |
| 6,681,778 | B1 * | 1/2004 | Salisbury et al. | 132/277 |
| 7,174,902 | B2 * | 2/2007 | Rizzuto | 132/277 |
| 7,299,808 | B2 * | 11/2007 | Lau | 132/277 |
| 2004/0154633 | A1 * | 8/2004 | Rogers et al. | 132/277 |
| 2004/0182411 | A1 * | 9/2004 | Rogers et al. | 132/277 |
| 2004/0231691 | A1 | 11/2004 | Shyu | |
| 2008/0149129 | A1 * | 6/2008 | Yang | 132/277 |
| 2009/0090379 | A1 * | 4/2009 | Potut | 132/277 |
| 2009/0272398 | A1 * | 11/2009 | Chudzik et al. | 132/277 |
| 2009/0277469 | A1 * | 11/2009 | Hsu | 132/277 |
| 2010/0139687 | A1 * | 6/2010 | Hsu | 132/277 |
| 2010/0242987 | A1 * | 9/2010 | Washington | 132/275 |
| 2011/0030719 | A1 * | 2/2011 | Yang | 132/277 |

* cited by examiner

HAIR CLIP WITH CONCEALED HINGE SPRING

CROSS-REFERENCE TO RELATED APPLICATION

This application claims the priority benefit of U.S. Provisional Patent Application Ser. No. 61/049,111, filed Apr. 30, 2008, the entire scope and content of which is hereby incorporated herein by reference.

TECHNICAL FIELD

The present invention relates generally to hairstyling accessories, and, in particular, to hair clips with springs for biasing them closed.

BACKGROUND OF THE INVENTION

Hair clips such as claw clips, jaw clips, barrettes, etc. come in different sizes and are typically worn in the hair for different styling solutions. Conventional hair clips include two body members that are pivotally coupled together by a spring-biased hinge. One common consumer frustration is that when a claw clip is worn the hair can get caught in the hinge mechanism, particularly in the torsion spring commonly used in hinges of conventional claw clips. Another common complaint among typical consumers is that the exposed torsion spring is aesthetically displeasing because it can be readily seen when the hair clip is worn.

In an effort to solve these problems, others have developed the concealed hinge spring mechanisms of U.S. Pat. Nos. 6,354,307 and 5,842,482. Each of these patents discloses a hair clip including a concealed hinge spring mechanism having a spring casing with an end notch through which the spring is inserted into the casing. These patents disclose solutions that conceal the spring in the hinge mechanism to some benefit, but none has proven to be entirely satisfactory.

Accordingly, it can be seen that needs exist for improved hair clips that are less likely to entangle the user's hair and are more aesthetically pleasing when worn in the hair. It is to the provision of solutions to these and other problems that the present invention is primarily directed.

SUMMARY OF THE INVENTION

Generally described, the present invention provides a hair clip having first and second body members pivotally coupled together by a concealed-spring hinge mechanism. The first and second body members each include a handle section, a hair-gripping wing section, and an intermediate portion between the handle and wing sections. The hinge mechanism pivotally couples the first and second body members together at their intermediate portions for pivotal movement between a closed position with the wing sections engaging each other and an open position with the wing sections pivoted apart from each other. In particular, the hinge mechanism includes a housing that defines a cavity and a spring that is received in the cavity. The housing is formed by a peripheral wall that extends inwardly from the first body member toward the second body member and that cooperates with the first body member to close off the housing on all sides except for an access opening through which the spring is received. The second body member closes off the access opening and cooperates with the housing to conceal the spring so that in normal use the wearer's hair does not get tangled in the spring.

In an example embodiment, the peripheral wall includes four wall segments forming a cuboidal shape, with the access opening positioned at the inner end of the wall segments. A spring stop may be positioned within the housing extending inwardly from the first body member to set the position of the spring in the cavity. Two or another number of recesses may be formed in the peripheral wall (e.g., vertically aligned in bottom and top wall segments) adjacent the inner-end access opening to receive a first free end of the spring when the hair clip is pivoted between the closed and open positions, thereby leaving more of the peripheral wall to conceal the spring. In addition, a spring receiver arm may be provided extending inwardly from the second body member to engage the first spring free end. And the second spring free end may be contained within the housing abutting the peripheral wall and extending outwardly clear of the spring stop. The spring free biasing ends cooperatively bias the hair clip toward the closed position. Furthermore, the peripheral wall may have a top wall segment with a tapered end that slides under a cooperating top wall extending inwardly from the second body member to conceal the spring in the housing when the hair clip is pivoted between the closed and open positions.

In another aspect, the invention includes methods of manufacturing hair clips with concealed-spring hinge mechanisms. An example method includes the steps of a molding the first body member to include the housing peripheral wall and the spring stop in a one-piece construction, and molding the second body member to include the spring receiver arm in a one-piece construction. Then, the spring is inserted into the cavity defined by the housing through the inner-end access opening until it contacts and sets against the spring stop. The spring is oriented so that the first spring free end extends out of the cavity through the access opening and through a lower recess in an inner end of a bottom segment of the peripheral wall and so that the second spring free end is within the cavity and abuts against the bottom segment of the peripheral wall. Next, the second body member is placed adjacent the housing with the first free spring end engaging the spring receiver arm to pre-tension the spring. And finally a spring pin is inserted through the first and second body members and through the spring to pivotally couple the body members together.

The specific techniques and structures employed by the invention to improve over the drawbacks of the prior devices and methods and accomplish the advantages described herein will become apparent from the following detailed description of the example embodiments of the invention and the appended drawings and claims.

DETAILED DESCRIPTION OF EXAMPLE EMBODIMENTS OF THE INVENTION

Generally described, the present invention provides a hair clip having two body members that are pivotally coupled together by a concealed-spring hinge mechanism. The hinge mechanism includes a housing and a spring concealed within the housing so that in use the wearer's hair does not get caught in the spring. In addition, the housing of the hinge mechanism preferably is of a one-piece construction that is easier and less expensive to manufacture and assemble relative to known hair clips.

Figure 2:
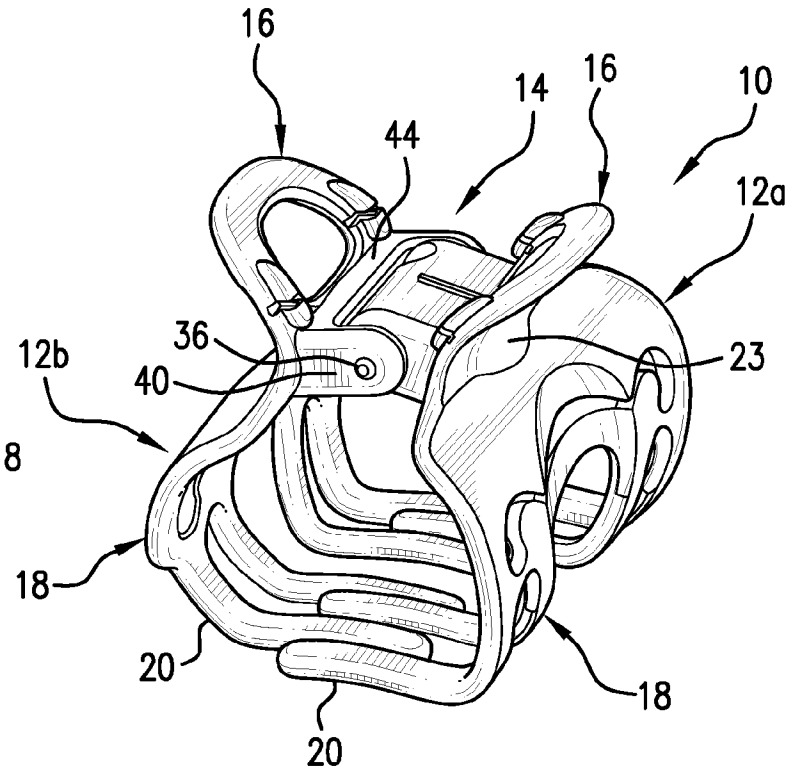
FIG. 2 is a right perspective view of the hair clip of FIG. 1.
Figure 1:
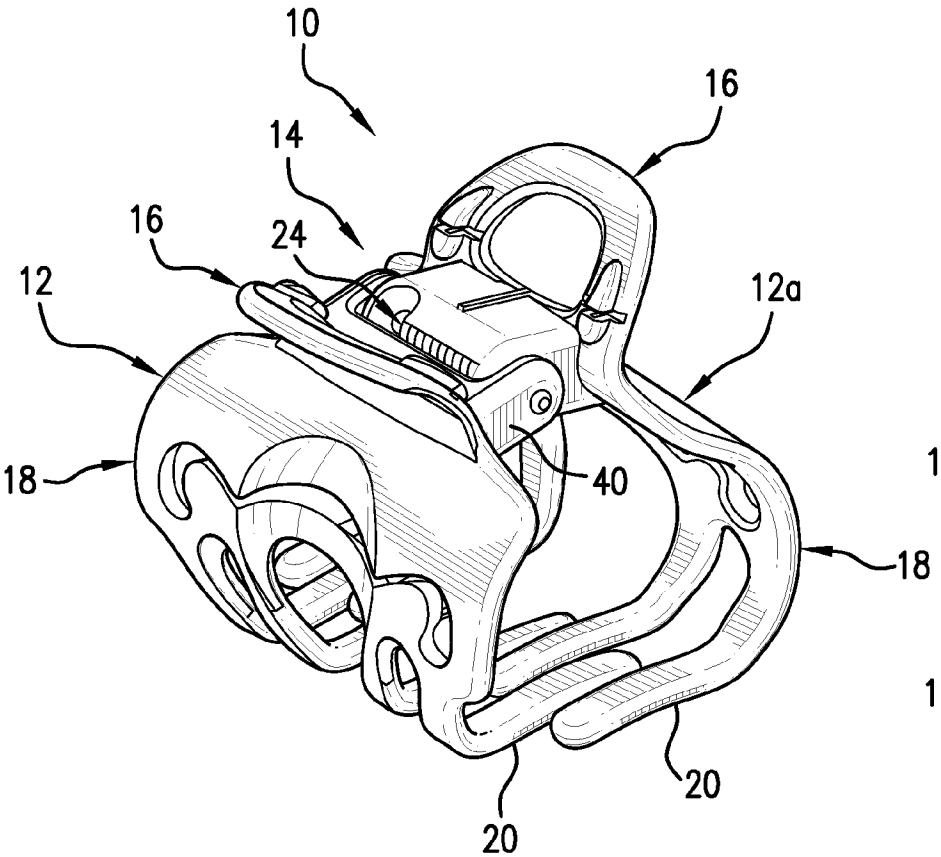
FIG. 1 is a left perspective view of a hair clip according to a first example embodiment of the present invention, showing a spring-hinge mechanism with the spring concealed.
Figure 3:
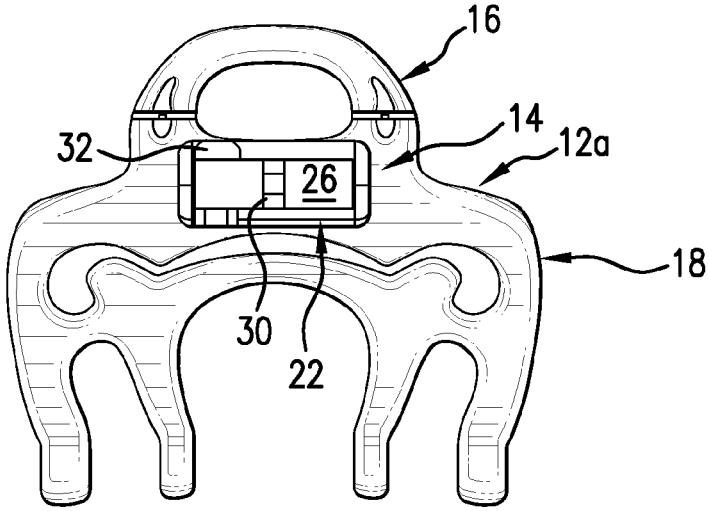
FIG. 3 is a left side view of a first pivotal body member of the hair clip of FIG. 1, showing details of the housing that conceals the spring.
Figure 4:
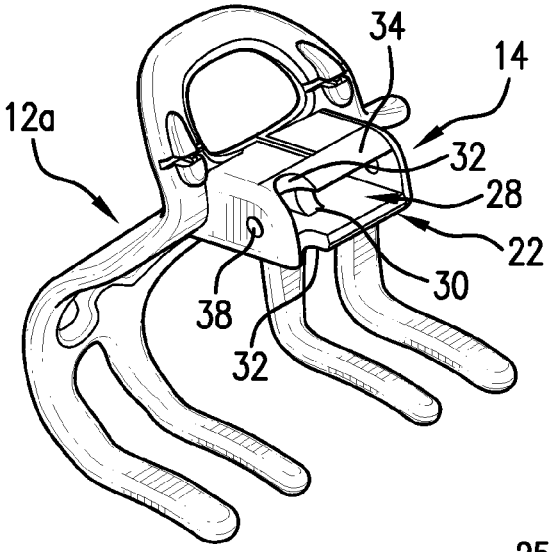
FIG. 4 is a left perspective view of the body member of FIG. 3.
Figure 5:
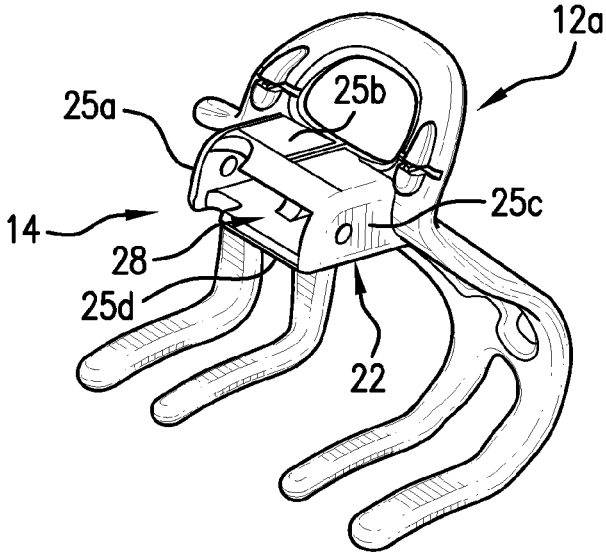
FIG. 5 is a right perspective view of the body member of FIG. 3.

FIGS. 1-11 show a hair clip 10 according to an example embodiment of the present invention. As shown in FIGS. 1-2, the hair clip 10 has two body members 12*a* and 12*b* (collectively, "the body members 12") that are pivotally coupled together by a concealed-spring hinge mechanism 14. The body members 12 each include a handle section 16 and a wing section 18. Each wing section 18 includes a plurality of hair-gripping teeth 20. The handle sections 16 are designed for the user to grip and press together against the biasing force of the spring-biased hinge mechanism 14 to pivot the wing sections 18 from a closed/in-use position with the teeth 20 interposed with each other (see FIGS. 1-2 and 6-7) to an open position with the teeth 20 moved apart from each other (see FIG. 8). In the closed position the teeth 20 cooperate to engage and hold the wearer's hair in a pre-arranged style, and in the open position the hair clip 10 can be placed into or removed from the hair.

Figure 10:
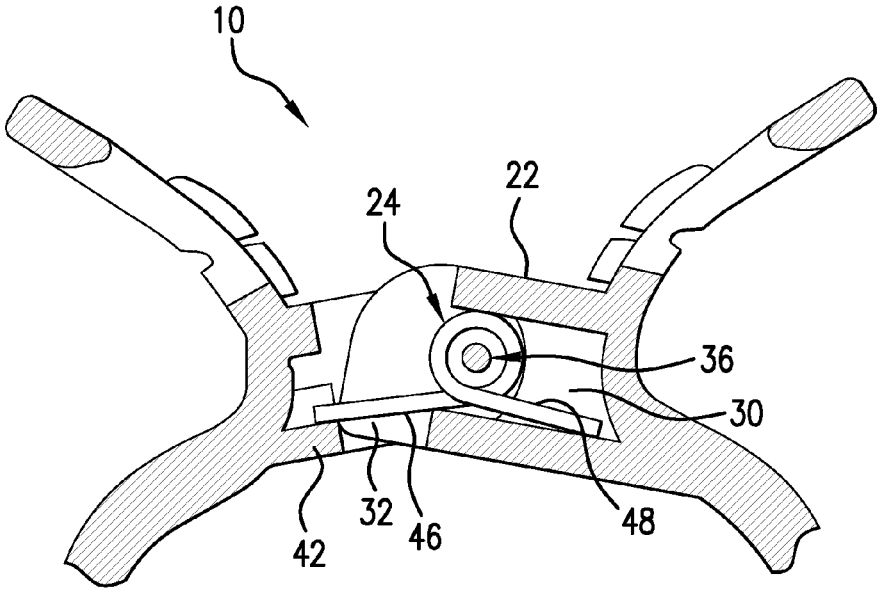
FIG. 10 is a cross-sectional view taken of line 10-10 of a portion of the hair clip of FIG. 6 in the closed position.
Figure 11:
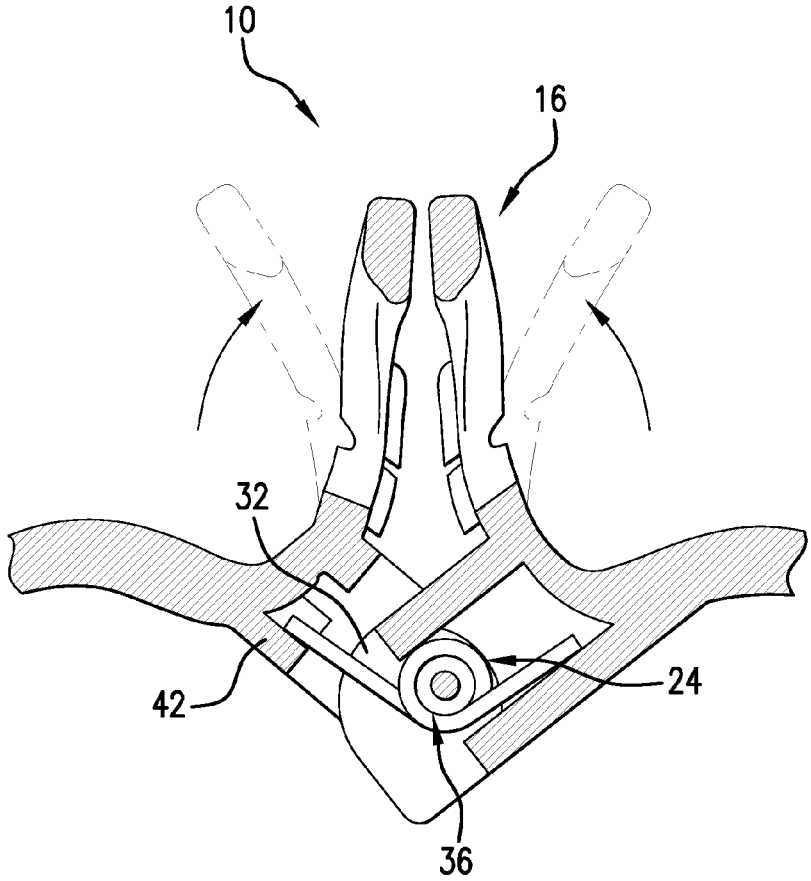
FIG. 11 shows the hair clip portion of FIG. 10 in the open position.

As shown in FIGS. 4-9, the concealed-spring hinge mechanism 14 includes a housing 22 and a spring 24 that is concealed within the housing. In the depicted embodiment, the spring 24 is provided by a conventional torsion spring with a helically coiled body and with two free biasing ends extending from the body, as best seen in FIGS. 1 and 10-11. In alternative embodiments, other conventional spring elements can be used as may be desired.

Figure 7:
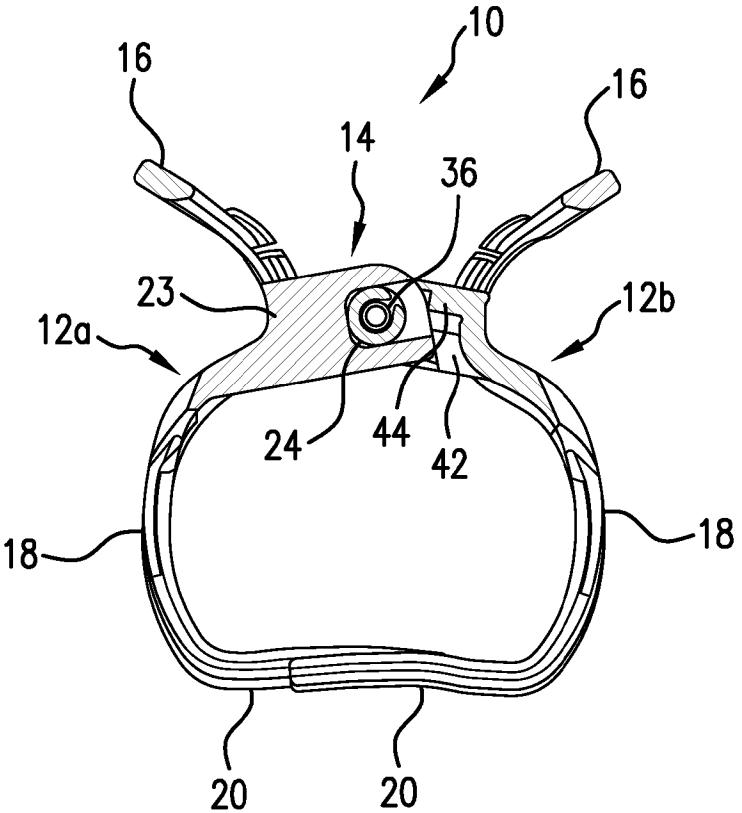
FIG. 7 is a cross-sectional view taken of line 7-7 of the hair clip of FIG. 6.
Figure 6:
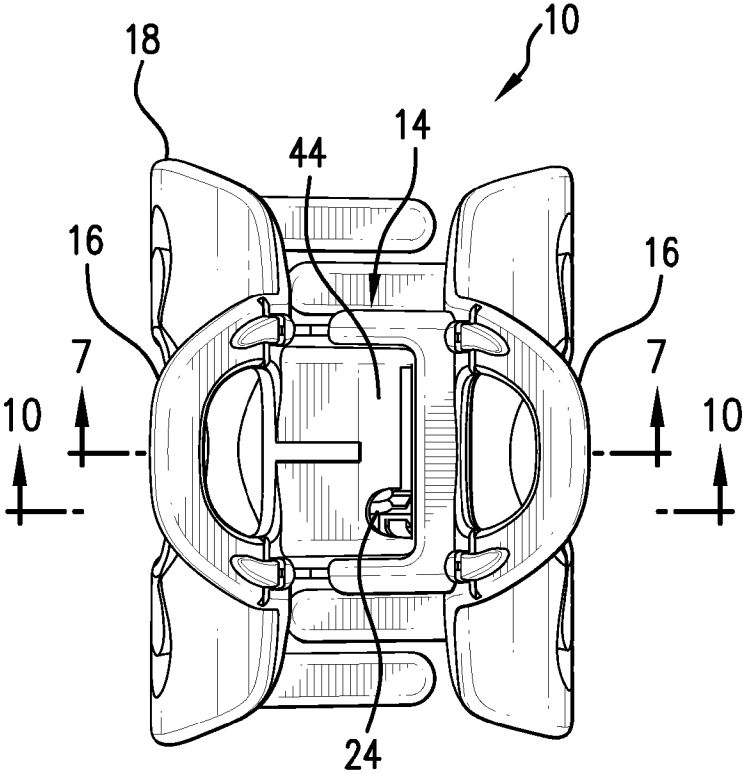
FIG. 6 is a plan view of the hair clip of FIG. 1.
Figure 8:
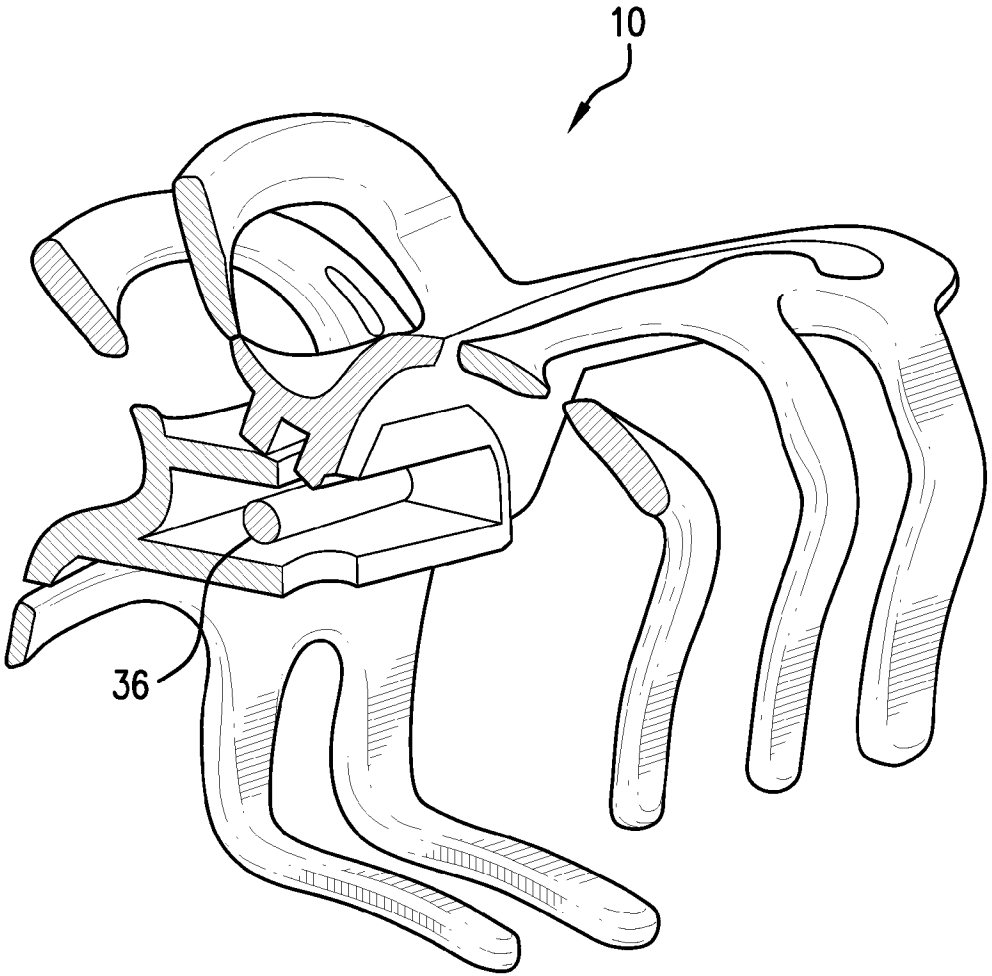
FIG. 8 is a perspective cutaway view of the hair clip of FIG. 1.
Figure 9:
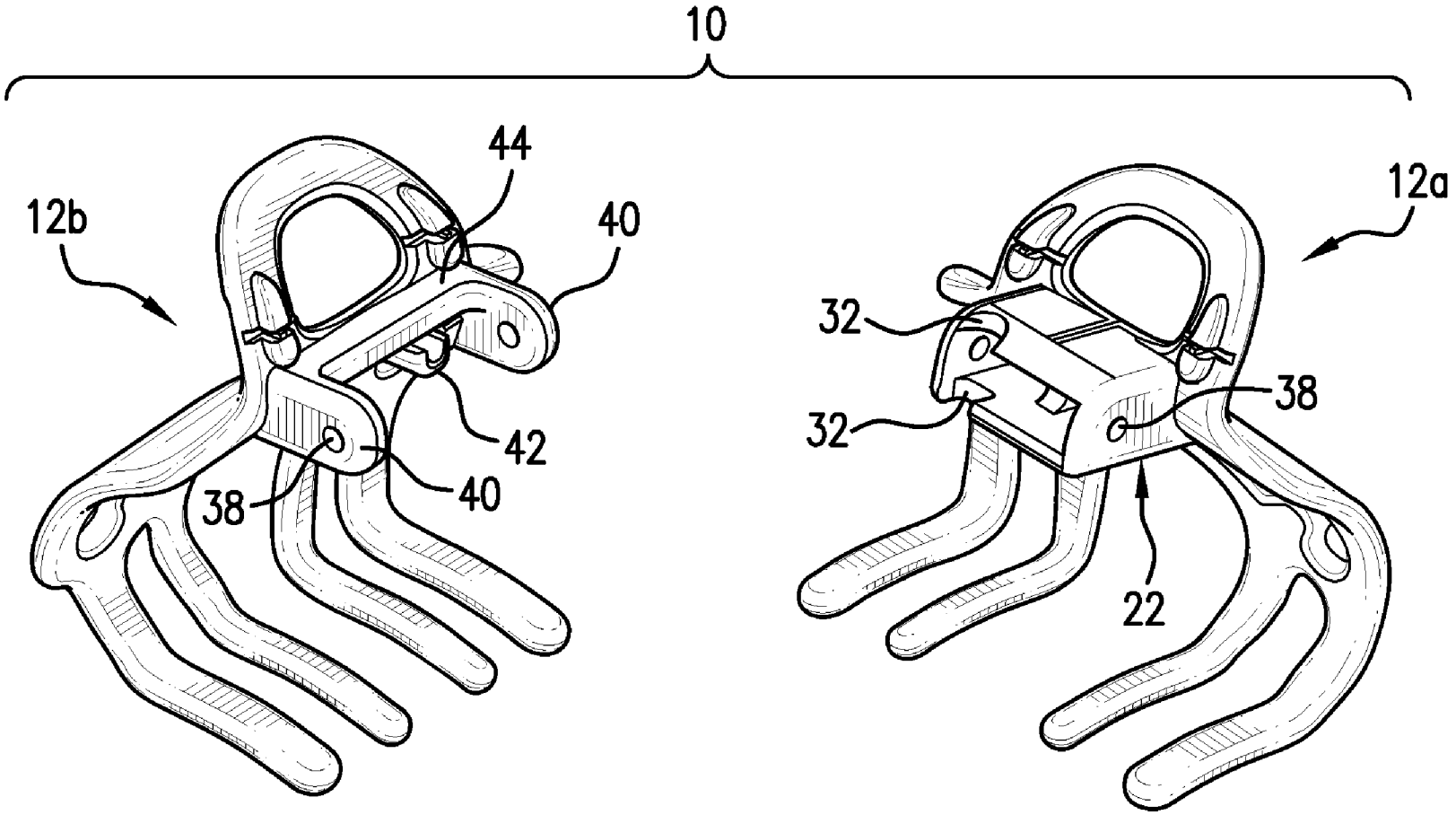
FIG. 9 is an exploded view of the hair clip of FIG. 1, without the spring.

As used herein, the term "concealed" means that the spring 24 is sufficiently enclosed within the housing 22 such that, in the normal and well-known use of such hair clips, the user's hair does not typically come into contact with and get entangled in the spring. Thus, the term "concealed" does not necessarily mean that the spring 24 is completely hidden from view when the hair clip 10 is in use in the closed position. Rather, the spring 24 may be slightly/partially visible, as can be seen in FIGS. 1, 6, and 7, but it is sufficiently recessed within and covered by the housing 22 that it is not exposed enough to become entangled in the wearer's hair in normal use.

The spring housing 22 is formed by a peripheral wall that extends inwardly from a first one of the body members 12*a* toward a second one of the body members 12*b*, defines a spring cavity 26, and has an inner end with an access opening 28 in communication with the cavity. In the depicted embodiment, the housing 22 has an outer end wall 23 (see FIGS. 2 and 7) defined by the first body member 12*a* and four peripheral sidewall segments 25*a-d* (collectively, "the sidewalls 25") (see FIG. 5) that extend inwardly from the first body member and cooperate with the outer end wall to define the cavity 26 in a generally cuboidal shape (including square and non-square rectangular shapes). Thus, the housing 22 is closed off on five sides to conceal the spring 24 and is open only on its inner-facing side. In alternative embodiments, the outer wall is a separate structure from the body member, the housing includes a single continuous curved peripheral sidewall, the housing defines a cylindrical, polygonal, or other regular- or irregularly-shaped cavity, and/or the access opening is positioned extending through the housing closer to the handles (e.g., through the top or bottom wall of the housing).

In addition, in typical commercial embodiments the spring housing 22 includes a spring stop 30, two (or another number) of sidewall recesses 32, and one or more tapered inner-end segments 34 of the sidewalls 25. The spring stop 30 sets the position of the spring 24 in the housing 22 by limiting how far into the cavity 26 the spring body can be inserted (see FIGS. 4-5 and 10-11). The spring stop 30 may be provided by a rib (or a plurality of them) extending inwardly (toward the other body member) from the first body member 12*a* and having a curved inner surface against which the cylindrical body of the torsion spring 24 sets. The spring stop 30 does not extend the entire length of the cavity 26 or the spring 24 (see FIGS. 4-5) so that it does not interfere with the second free end 48 of the spring, which extends outwardly within the cavity past the inner surface of the spring stop (see FIGS. 10-11). In alternative embodiments, the spring stop 30 is provided by a wider rib that extends more or all of the length of the spring 24, except for the second free end 48 of the spring.

The sidewall recesses 32 make it easier to properly insert the spring 24 into the housing 22 through the access opening 28 and provide clearance for the first free end 46 of the spring (see FIGS. 10-11). The two sidewall recesses 32 of the depicted embodiment are vertically aligned and formed in the top and bottom sidewalls 25*b* and 25*d* at the inner end of the housing, adjacent and in communication with the access opening 28 (see FIGS. 3-5). The lower one of the recesses 32 receives the first free end 46 of the spring 24 downwardly through it when the hair clip 10 is in the closed position (see FIG. 10) and the upper one of the recesses receives the spring's first free end upwardly through it when the hair clip is in the open position (see FIG. 11). The upper and lower recesses 32 extend no farther into the top and bottom sidewalls 25*b* and 25*d* than is needed to provide clearance for the first end 46 of the spring 24 in the open and closed positions. In this way, the top and bottom sidewalls 25*b* and 25*d* are more extensive, thereby concealing the spring 24 in the housing 22. In alternative embodiments, the recesses are formed as channels in the inner surface of the housing sidewalls and do not extend through to the outer surface of the sidewalls.

The tapered inner-end segment 34 of the top sidewall 25*b* cooperates with the second body member 12*b* without interfering with it to help conceal the spring 24. In particular, the depicted embodiment includes a top wall 44 extending inwardly (toward the first body member 12*a*) from the second body member 12*b* and extending between the sidearms 40 of the second body member so that it cooperates with the housing 22 to help conceal the spring 24 when the hair clip 10 is in the closed or open position. The tapered inner-end segment 34 of the top wall 25*b* of the housing 22 of the first body member 12*a* slides under the top wall 44 of the second body member 12*b* when the hair clip is pivoted to the open position (see FIGS. 10-11).

As noted above, the housing 22 of the depicted embodiment is closed off on all sides (e.g., by the outer end 23 and the four sidewalls 23*a-d*) except one (e.g., the inner-end access opening 28) to conceal the spring 24. The inner end access opening 28 is closed off to conceal the spring 22 by the second body member 12*b* and the top wall 44 of the second body member. In alternative embodiments, the second body member is additionally provided with a bottom wall extending inwardly therefrom and extending between the sidearms so that it cooperates with the housing to further close off the access opening and conceal the spring.

The first and second free biasing ends 46 and 48 of the torsion spring 24 bias the body members 12 toward the closed position. In the depicted embodiment, the second free end 48 of the spring 24 abuts and biases against the bottom wall 25*d* of the housing 22 when the hair clip is pivoted to the open position (see FIG. 11). In addition, the second body member 12*b* has a spring receiver 42 that receives the first free end 46 of the spring 24. The spring receiver 42 of the depicted embodiment is provided by an arm (e.g., a ledge with a semi-tubular spring-receiving surface) that extends inwardly from the second body member 12*b*. The second free end 48 of the spring 24 abuts and biases against the spring receiver 42 when the hair clip 10 is pivoted to the open position (see FIGS. 9-11). In an alternative embodiment, the spring receiver is defined by a bottom wall extending inwardly from the second body member. In another alternative embodiment, the first and second free ends of the spring abut and bias against top walls of the second and first body members.

In the depicted embodiment, the spring 24 is held in place within the housing 22, and the two body members 12 are pivotally held together, by a spring pin 36 that is inserted through the central bore of the spring and through aligned pin holes 38 in the sidewalls 25*a* and 25*c* of the housing 22 and in cooperating sidearms 40 of the second body member 12*b* (see FIGS. 2 and 7-9). In typical commercial embodiments, the spring pin 36 is secured in place by friction in an interference fit to secure the spring 24 in place concealed within the housing 22.

To manufacture/assemble the hair clip 10, two of the body members 12 and one of the springs 24 are provided. Then the spring 24 is inserted into the cavity 26 through the inner end access opening 28 until its body contacts and sets against the spring stop 30. Next, the spring 24 is oriented so that its first free end 46 extends inwardly (i.e., toward the second body member 12*b*) out of the cavity 26 through the access opening 28 and through a lower one of the recesses 32, and so its second free end extends outwardly (i.e., toward the first body member 12*a*) within the cavity 26 and past the spring stop 30. Then the second body member 12*b* is placed with its cooperating sidearms 40 adjacent the housing 22 and with the first free spring end 46 engaging (e.g., extending onto and abutting against) the spring receiver 42 to pre-tension the spring. Then the spring pin 36 is inserted through the aligned pin holes 38 in the sidewalls 25*a* and 25*c* of the housing 22 and in the cooperating sidearms 40, and through the center bore of the spring 24.

In the depicted embodiment, the spring housing 22 and the spring stop 30 are molded (or otherwise formed) onto the first body member 12*a* during its initial fabrication in the manufacturing process in a single step. Thus, the spring housing 22, the spring stop 30, and the first body member 12*a* are of a one-piece construction (as opposed to being separately fabricated and mounted together). Likewise, the spring receiver 42 is molded (or otherwise formed) onto the second body member 12*b* during its initial fabrication in the manufacturing process in a single step. Thus, the spring receiver 42 and the second body member 12*b* are of a one-piece construction (as opposed to being separately fabricated and mounted together). This allows for a reduced tooling complexity compared to known concealed-spring hair clip designs, which results in less-expensive tooling, thereby reducing manufacturing cost. In addition, the spring 24 is assembled into the spring hinge mechanism 14 in a one-step process instead of the conventional two-step process, thereby reducing the assembly time and costs.

With the hair clip 10 so manufactured and assembled, the handle sections 16 can be pressed together to move the teeth 20 toward the open position. The first free spring end 46 abuts and is constrained against the spring receiver 42 to bias the body members 12 against such movement (instead biasing the teeth 20 toward their closed position). As the teeth 20 are moved toward the open position, the housing 22 rotates relative to the spring 24 until the first free spring end 46 is received into the upper one of the recesses 32 to provide the needed clearance for the hair clip 10 to be moved all the way to the open position (see FIG. 11).

The hair clip 10 can be made by conventional manufacturing techniques using conventional materials. For example, in typical commercial embodiments the body members 12 of the hair clip 10 are injection molded of a plastic such as ABS, Nylon, PP, PE, Acrylic, PVC, etc.

In alternative embodiments, the housing is formed in a separate step and mounted to the first body member. In another alternative embodiment, the housing and the first body member cooperatively form a spring cavity that is enclosed except for an inner end access opening in communication with the cavity so that the end access opening receives the spring therethrough during assembly but is closed off (to retain the spring in the cavity) by one of the side-arms of the second body member. In yet other alternative embodiments, the present invention includes hair clips other than the depicted claw clips that have the same or a similar concealed-spring hinge mechanism. Such hair clips include jaw clips, barrettes, etc. Persons skilled in the art will understand how to modify such hair clips to incorporate the concealed-spring hinge mechanism. For example, in an alternative embodiment in which the hair clip is a barrette, the body members to not include the teeth of the embodiment described herein.

It is to be understood that this invention is not limited to the specific devices, methods, conditions, or parameters described and/or shown herein, and that the terminology used herein is for the purpose of describing particular embodiments by way of example only. Thus, the terminology is intended to be broadly construed and is not intended to be limiting of the claimed invention. For example, as used in the specification including the appended claims, the singular forms "a," "an," and "one" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

While the invention has been shown and described in exemplary forms, it will be apparent to those skilled in the art that many modifications, additions, and deletions can be made therein without departing from the spirit and scope of the invention as defined by the following claims.

What is claimed is:

1. A clip for wearing in hair, comprising:

first and second body members each including a handle section, a hair-gripping wing section, and an intermediate portion between the handle and wing sections; and a hinge mechanism pivotally coupling the first and second body members together at their intermediate portions for pivotal movement between a closed position with the wing sections engaging each other and an open position with the wing sections pivoted apart from each other, the hinge mechanism including a housing defining a cavity and including a spring received within the cavity, the housing including a peripheral wall that extends inwardly from the first body member toward the second body member and that cooperates with the first body member to close off the housing on all sides except for an access opening through which the spring is received, wherein the second body member closes off the access opening and cooperates with the housing to conceal the spring so that in normal use the wearer's hair does not get tangled in the spring, and wherein the spring is a torsion spring with two free ends and the housing defines two recesses adjacent and in communication with the access opening, wherein one of the spring free ends extends through a first one of the recesses when the hair clip is in the closed position and extends through a second one of the recesses when the hair clip is in the open position.

2. The hair clip of claim 1, wherein the access opening is formed at an inner end of the housing.

3. The hair clip of claim 1, wherein the peripheral wall includes four sidewall segments forming the housing in a generally cuboidal shape.

4. The hair clip of claim 1, wherein the first body member includes a spring stop that is positioned within the housing, extends inwardly toward the second body member, and is adapted to set the position of the spring in the housing.

5. The hair clip of claim 4, wherein the spring has a length and the spring stop includes a rib that does not extend the length of the spring.

6. The hair clip of claim 4, wherein the spring is provided by a torsion spring with two free ends, and one of the spring free ends is contained within the housing and extends outwardly toward the first body member without interfering with the spring stop.

7. The hair clip of claim 4, wherein the spring stop includes a curved inner surface against which the spring sets.

8. The hair clip of claim 1, wherein the peripheral wall is formed by four sidewall segments forming the housing in a cuboidal shape, the first recess is formed in a bottom one of the sidewalls with the spring free end extending downwardly through it, the second recess is formed in a top one of the sidewalls with the spring free end extending upwardly through it, and the first and second recesses are vertically aligned.

9. The hair clip of claim 1, wherein the second body member includes a spring receiver arm extending inwardly toward the first body member, the spring is provided by a torsion spring with two free ends, and one of the spring free ends extends out of the cavity, through the access opening, and into abutment with the spring receiver arm so that the spring free end is biased against the spring receiver arm when the hair clip is pivoted from the closed position to the open position.

10. The hair clip of claim 9, wherein the spring receiver arm defines a tubular surface upon which the spring free end abuts.

11. The hair clip of claim 1, wherein the spring is provided by a torsion spring with two free ends, wherein one of the free ends abuts and biases against the peripheral wall.

12. The hair clip of claim 1, wherein the peripheral wall includes a top wall with a tapered inner-end segment, the second body member includes a top wall extending inwardly toward the first body member, the second body top wall cooperates with the first body top wall to conceal the spring within the housing, and the tapered inner-end segment of the first body top wall slides under the second body top wall when the hair clip is pivoted from the closed position to the open position.

13. A clip for wearing in hair, comprising:

first and second body members each including a handle section, a hair-gripping wing section, and an intermediate portion between the handle and wing sections; and a hinge mechanism pivotally coupling the first and second body members together at their intermediate portions for pivotal movement between a closed position with the wing sections engaging each other and an open position with the wing sections pivoted apart from each other, the hinge mechanism including a housing defining a cavity and including a torsion spring received within the cavity and having two free ends, wherein the housing includes a peripheral wall that extends inwardly from the first body member toward the second body member and that cooperates with the first body member to close off the housing on all sides except for an access opening through which the spring is received, the peripheral wall includes four sidewall segments forming the housing in a generally cuboidal shape, and the access opening is formed at an inner end of the housing, wherein the housing defines two vertically aligned recesses adjacent and in communication with the access opening, with a lower one of the recesses formed in a bottom wall segment of the peripheral wall and with an upper one of the recesses formed in a top wall segment of the peripheral wall, wherein a first one of the spring free ends extends inwardly toward the second body member and out of the cavity through the inner-end access opening, downwardly through the lower recess when the hair clip is in the closed position, and upwardly through the second recess when the hair clip is in the open position, wherein the second body member includes a spring receiver arm extending inwardly toward the first body member and the first spring free end extends into abutment with the spring receiver arm so that the first spring free end is biased against the spring receiver arm when the hair clip is pivoted from the closed position to the open position, wherein the second spring free end abuts and biases against the bottom wall segment of the peripheral wall, and wherein the second body member closes off the inner-end access opening and cooperates with the housing to conceal the spring so that in normal use the wearer's hair does not get tangled in the spring.

14. The hair clip of claim 13, wherein the top peripheral wall segment includes a tapered inner-end segment, the second body member includes a top wall extending inwardly toward the first body member, the second body top wall cooperates with the first body top wall to conceal the spring within the housing, and the tapered inner-end segment of the first body top wall slides under the second body top wall when the hair clip is pivoted from the closed position to the open position.

15. The hair clip of claim 13, wherein the spring receiver arm defines a tubular surface against which the first spring free end abuts.

16. The hair clip of claim 13, wherein the first body member includes a spring stop that is positioned within the housing, extends inwardly toward the second body member, and is adapted to set the position of the spring in the housing.

17. The hair clip of claim 16, wherein the spring has a length, the spring stop includes a rib that does not extend the length of the spring, and the second spring free end is contained within the housing and extends outwardly toward the first body member without interfering with the spring stop.

18. The hair clip of claim 16, wherein the spring stop includes a curved inner surface against which the spring sets.

19. A method of manufacturing the hair clip of claim 16, the method comprising:

molding the first body member to include the housing peripheral wall and the spring stop in a one-piece construction;

molding the second body member to include the spring receiver arm in a one-piece construction;

inserting the spring into the cavity defined by the housing through the inner-end access opening until it contacts and sets against the spring stop with the first spring free end extending out of the cavity through the access opening and through the lower recess and with the second spring free end within the cavity and abutting against the bottom segment of the peripheral wall;

placing the second body member adjacent the housing with the first free spring end engaging the spring receiver arm to pre-tension the spring; and inserting a spring pin through the first and second body members and through the spring to pivotally couple the body members together.

* * * * *